United States Patent [19]

Nohira et al.

[11] 3,974,807

[45] Aug. 17, 1976

[54] FLOW CONTROL VALVE ASSEMBLY FOR EXHAUST GAS RECIRCULATION SYSTEM

[75] Inventors: Hidetaka Nohira; Masaaki Tanaka, both of Susono, Japan

[73] Assignee: Toyota Jidosha Kogyo Kabushiki Kaisha, Japan

[22] Filed: Apr. 11, 1975

[21] Appl. No.: 567,192

[30] Foreign Application Priority Data

Apr. 16, 1974 Japan ..... 49-41651

[52] U.S. Cl. ..... 123/119 A

[51] Int. Cl.[2] ..... F02M 25/00

[58] Field of Search ..... 123/119 A

[56] References Cited

UNITED STATES PATENTS 3,796,049 3/1974 Hayashi ..... 123/119 A

*Primary Examiner*—Charles J. Myhre
*Assistant Examiner*—R. H. Lazarus
*Attorney, Agent, or Firm*—Toren, McGeady and Stanger

[57] ABSTRACT

Herein disclosed is a flow control valve assembly for use in an exhaust gas recirculation system in which engine exhaust gases are recirculated from the exhaust system to the intake system of an internal combustion engine so as to clean the engine exhaust gases. The flow control valve assembly comprises a first valve interposed between its inlet and outlet ports for regulating its effective area for the exhaust gases. The first valve includes an orifice, a valve seat, a constant-pressure chamber defined inbetween, and a valve member movable between a seated position and an open position. The control valve assembly further comprises diaphragm means for acutating the valve member and including a diaphragm connected to the valve member, a diaphragm chamber having fluid communication with an air source under pressure, and an air bleed hole formed in the diaphragm. The control valve assembly further comprises a second valve including a valve member, which is movable between a seated position and an open position in response to the pressure in the constant-pressure chamber for regulating the effective area of the air bleed hole, so that the amount of air bleed may be controlled by the second valve to maintain the pressure of the exhaust gases in the constant-pressure chamber substantially at the atmospheric level. Thus, the control valve assembly can provide such recirculation of the exhaust gases as is proportional to the amount of the intake mixture.

7 Claims, 2 Drawing Figures

FLOW CONTROL VALVE ASSEMBLY FOR EXHAUST GAS RECIRCULATION SYSTEM

BACKGROUND OF THE INVENTION

1. Field of the Invention

The present invention relates to a flow control valve assembly, and more particularly to a flow control valve assembly for regulating the flow rate of the exhaust gases, which are to be recirculated in an exhaust gas recirculation system from the exhaust system to the intake system of an internal combustion engine so as to clean the engine exhaust gases.

2. Description of the Prior Art

Generally speaking, it is considered necessary in the relevant art that the amount of the exhaust gases to be recirculated from the engine exhaust system to the engine intake system be proportional to the amount of an air-fuel mixture to be sucked into the engine body so as to clean the engine exhaust gases. For this purpose, there has been proposed a flow control valve which is operative to regulate the amount of the exhaust gas recirculation by resorting to the fact that the exhaust gas pressure is proportional to the amount of the mixture intake. This prior art control valve has its effective area controlled by having its diaphragm exposed to the exhaust gas pressure. In this instance, however, the exhaust gas pressure acting upon the diaphragm will often be pulsating during its operation, or the diaphragm itself will often be deteriorated by the heat transferred from the exhaust gases. In another proposal, on the other hand, the flow control valve is controlled partly by detecting the variation in the amount of the sucked mixture in terms of the exhaust gas pressure and partly by applying the intake vacuum to the diaphragm. In this instance, however, reliable control of the flow control valve cannot be expected because the intake vacuum becomes the weaker when the supply of the intake mixture into the engine body is the more.

SUMMARY OF THE INVENTION

It is, therefore, a general object of the present invention to eliminate the above drawbacks concomitant with the conventional flow control valve to be used in the exhaust gas recirculation system.

A major object of the present invention is to provide an improved control valve assembly for use in an exhaust gas recirculation system, which assembly prevents the engine exhaust gases from acting directly upon its diaphragm to thereby prevent its components such as the diaphragm from being deteriorated by the heat of the exhaust gases and further to thereby have its operation reliably controlled by a strong positive pressure which is built up in accordance with the exhaust gas pressure.

Another object of the present invention is to provide an improved control valve assembly of the above type, in which its control portion for accomplish bleed of the positive pressure and its opening control portion in the exhaust gas passage are constructed in a compact and integral manner.

According to a primary aspect of the present invention, therefore, there is provided a flow control valve assembly for use in an exhaust gas recirculation system, which assembly comprises: an inlet port having fluid communication with the exhaust system of an internal combustion engine; an outlet port having fluid communication with the intake system; first valve means interposed between the inlet port and the outlet port and including an orifice, a valve seat formed downstream of the orifice, a constant-pressure chamber defined between the orifice and the valve seat, and a valve member movable between a seated position and an open position for regulating the effective area of a flow passage of the exhaust gases between itself and the valve seat; diaphragm means for moving the valve member and including a diaphragm connected to the valve member and movable together with the same when the pressure difference exceeds a predetermined level, a diaphragm chamber defined by the diaphragm and having fluid communication with an air source under pressure, and an air bleed hole formed in the diaphragm; and second valve means including a valve member movable between a seated position and an open position in response to the pressure in the constant-pressure chamber for regulating the effective area of the air bleed hole, so that the amount of air under pressure from the diaphragm chamber may be controlled by the valve member of the second-named valve means to maintain the pressure of the exhaust gases in the constant-pressure chamber substantially at the atmospheric level.

BRIEF DESCRIPTION OF THE DRAWING

Other objects and advantages of the present invention will now become apparent from the following description taken in conjunction with the accompanying drawing, in which.

DESCRIPTION OF THE PREFERRED EMBODIMENTS

Figure 1:
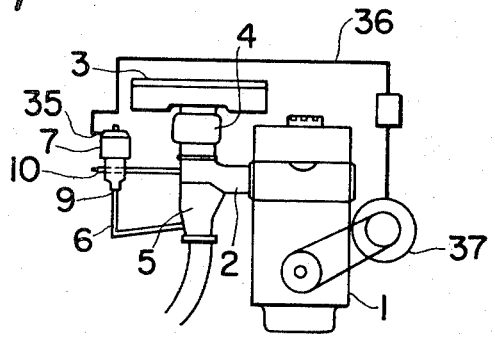
FIG. 1 is a diagrammatical view showing an exhaust gas recirculation system into which a flow control valve assembly according to the present invention is to be incorporated.
Figure 2:
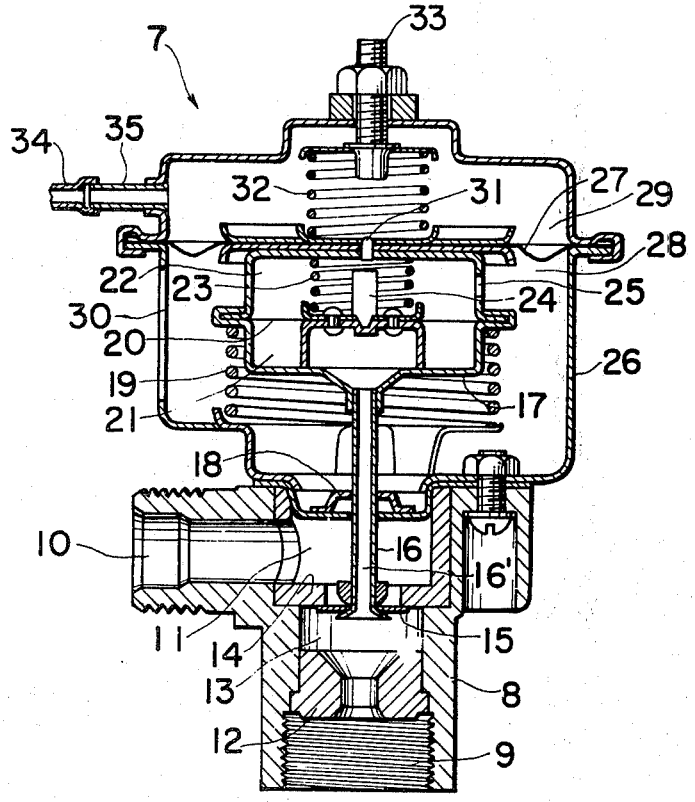
FIG. 2 is a longitudinal section showing more specifically the flow control valve assembly of the present invention.

A flow control valve assembly according to present invention will now be described with reference to FIGS. 1 and 2. As is customary, an air-fuel mixture gases are supplied into an intake pipe 2 of an engine body 2 by way of an air cleaner 3 and a carbureter 4. The combustion or exhaust gases produced in the engine body 1 are then discharged to the atmosphere by way of an exhaust pipe 5. This exhaust pipe 5 and the intake pipe 2 are communicated with each other by an exhaust gas recirculation passage 6, in which a flow control valve assembly 7 according to the present invention is mounted so as to regulate the flow rate of the engine exhaust gases to be recirculated.

Within a valve structure 8 of the flow control valve assembly 7, there are disposed an inlet port 9 and an outlet port 10 both for the exhaust gases, and an L-shaped passage 11 which serves to provide fluid communication inbetween. From the inlet port 9 to the outlet port 10, moreover, there are disposed an orifice 12, a constant-pressure chamber 13 and a valve seat 14, in this order. A valve member 15 for regulating the effective area in the valve seat 14 is disposed in the constant-pressure chamber 13, and a valve stem 16 attached to this valve member 15 is constructed to protrude within the valve structure 8 and to have its leading end attached to a diaphragm casing 17. Between the valve stem 16 and the valve structure 8, on the other hand, is mounted a guide 18 having a bore, through which the former 16 is made hermetically slidable. A spring 19 is interposed between the diaphragm casing 17 and a diaphragm housing 26, which will be described later, so that it may urge the former 17 in the direction apart from the valve structure 8. The inside of the diaphragm casing 17 is divided by a diaphragm 20 into two diaphragm chambers 21 and 22, and the diaphragm chamber 21, which is positioned close to the valve structure 8, is made to have fluid communication with the constant-pressure chamber 13 by way of a through bore 16' which is formed in the valve stem 16. If preferred, this diaphragm chamber 21 may be communicated with the constant-pressure chamber 13 by a suitable flexible conduit. On the other hand, another spring 23 is inserted in the diaphragm chamber 22, which is apart from the valve structure 8, so as to urge the diaphragm 20, and a valve member 24 is attached to the center of the diaphragm 20 so as to regulate the effective area of an air bleed hole 31, which will be described later. An air vent hole 25 is formed in a side wall of the diaphragm casing 17 so as to provide fluid communication between the inside and outside of the diaphragm chamber 22. A larger diaphragm housing 26 enclosing the diaphragm casing 17 is attached to the valve structure 8. The inside of the diaphragm housing 26 is divided by another diaphragm 27 into two diaphragm chambers 28 and 29. Thus, the diaphragm casing 17 is accommodated in the diaphragm chamber 28, which is positioned close to the valve structure 8, and at the same time is attached to the diaphragm 27. The diaphragm chamber 28 is vented to the atmosphere by way of a side wall opening 30 which is formed in the diaphragm housing 26. The air bleed hole 31, which has been shortly touched in the above, is formed at those corresponding portions of both the diaphragm casing 17 and the diaphragm 27 to the valve member 24, so that the pressure in the diaphragm chamber 29 may be controlled by the effective area of the air bleed hole 31, which in turn is regulated by the valve member 24. A third spring 32 is fitted in the diaphragm chamber 29, which is positioned apart from the valve structure 8, so as to urge the diaphragm 27. The urging force of this spring 32 can be adjusted by an adjust screw 33, which is attached to the diaphragm housing 26, to such a level as is far weaker than that of the spring 19. To the diaphragm chamber 29 is attached an air inlet pipe 35, which is formed at its one end with a small hole 34 having a diameter of about 0.5mm. This air inlet pipe 35 is communicated by way of a conduit 36 having a not-numbered relief valve with an air pump 37, which is driven by the engine body 1. Here, it should be noted that the urging forces of the three springs 19, 23 and 32 are adjusted at such suitable levels that the pressure in the constant-pressure chamber 13 may be maintained substantially at the atmospheric level by bleeding the air in the diaphragm chamber 29 through the air bleed hole and further by allowing the exhaust gases in the constant pressure chamber 13 to be flown into the outlet port 10.

The operations of the flow control valve assembly according to the present invention will now be explained in the following. When the engine body 1 is operated with its number of revolution being smaller and with its air intake being less, the amount of the exhaust gases is kept accordingly at a lower level, and the exhaust gas pressure in the inlet port 9 is also at a lower level. The exhaust gases are introduced through the orifice 12 into the constant-pressure chamber 13, and the exhaust gas pressure is transmitted into the diaphragm chamber 21 by way of the through bore 16'. The pressure thus propagated is, however, at such a low level that it cannot overcome the urging force of the spring 23, thus leaving the valve member 24, which is attached to the diaphragm 20, apart from the air bleed hole 31. On the other hand, the air pumped out from the air pump 37 is guided through the conduit 36 and the air inlet pipe 35 and is metered in the small hole 34. In this way, the air is introduced into the diaphragm chamber 29. However, the air thus introduced is discharged to the atmosphere by way of the air bleed hole 31, the diaphragm chamber 22, the air vent hole 25, the diaphragm chamber 28 and the side wall opening 30, thus establishing the atmospheric pressure in the diaphragm chamber 29. (This is because the following relationship holds: the effective area of the small hole 34 is smaller than that of the air bleed hole 31, which in turn is smaller than that of the air vent hole 25.) As a result, the diaphragm 27 is moved by the action of the spring 19 apart from the inlet port 9 together with the diaphragm casing 17, the valve stem 16 and the valve member 15, with the result that the passage of the valve seat 14 is closed by the valve member 15.

When, on the other hand, a higher output power is required from the engine body 1, as experienced in the acceleration mode of operation of an automobile, the amounts of the combustible mixture to be sucked and the exhaust gases to be emitted are so increased as to accordingly boost the pressure of the exhaust gases in the inlet port 9. The exhaust gases are then introduced from the inlet port 9 into the constant-pressure chamber 13 by way of the orifice 12. The pressure of the exhaust gases thus introduced into the constant-pressure chamber 13 is then transmitted into the diaphragm chamber 21 by way of the through bore 16'. Since the pressure in the diaphragm chamber 21 is boosted in this way, the valve member 24 is moved apart from the inlet port 9 together with the diaphragm 20 against the urging action of the spring 23 until it shuts off the air bleed hole 31. When this occurs, the discharge air, which has been discharged from the diaphragm chamber 29 to the atmosphere through the air bleed hole 31, is confined and accumulated in the diaphragm chamber 29. When the pressure in this diaphragm chamber 29 is boosted as a result of the accummulation to a predetermined level, it exceeds the urging force of the spring 19 so that the diaphragm 27 may be moved toward the inlet port 9 together with the diaphragm casing 17, the valve stem 16 and the valve body 15, thus detaching the valve member 15 from its valve seat 14. As a result, the exhaust gases, which have been confined in the constant-pressure chamber 13, are allowed to flow into the intake pipe 2 by way of the outlet port 10 and further of the exhaust gas recirculation passage 6. As the discharge of the exhaust gases proceeds, the pressure in the constant-pressure chamber 13 is reduced with the result of the instant reduction of the pressure in the diaphragm chamber 21 always having fluid communication with the constant-pressure chamber 13. Then, the valve member is moved by the urging action of the spring 23 toward the inlet port 9 together with the diaphragm 20, thus opening again the air bleed hole 31. At this particular instant, the discharge air, which has been temporarily accummulated in the diaphragm chamber 29, is allowed to flow to the atmosphere by way of the air bleed hole 31 now open, with the resultant reduction in the pressure in the diaphragm chamber 29. Thus, the accummulated pressure, which has been pushing the diaphragm 27 toward the inlet port 9, yields to the biasing force of the spring 19 so that the diaphragm 27 is moved apart from the inlet port 9 together with the valve member 15 and the like. As a result, the effective area of the passage of the valve seat 14 is accordingly reduced by the valve member 15, and the amount of the exhaust gases to flow from the inlet port 9 to the outlet port 10 is also accordingly reduced to restore the pressure in the constant-pressure chamber 13.

During the running condition of the engine body 1, the flow control valve assembly 7 of the present invention can repeat the operations thus far described, and the exhaust gases in an amount proportional to the mount of suction of the combustible mixture can be recirculated. In the flow valve control assembly 7, it should be noted that the pressure in the constant-pressure chamber 13 is maintained substantially at the atmospheric level because the pressure in the diaphragm chamber 29, which is established by bleeding the air in the diaphragm chamber 29 through the air bleed hole 31, is balanced by the composed urging force of the springs 19 and 32.

Here, explanation will be made to the fact that the amount of the exhaust gases to be recirculated by way of the flow control valve assembly 7 is proportional to that of the air-fuel mixture to be sucked into the engine body 1. If it is assumed that the pressure in the inlet port 9 be $P_E$, the pressure in the constant-pressure chamber 13 $P_V$, and the atmospheric pressure $P_a$, then the following relationship will hold as to the amount $G_E$ of the exhaust gases to be recirculated, from the generally known flow equation and the relationship of $P_V \approx P_a$:

$$G_E \alpha \sqrt{P_E - P_V} = \sqrt{P_E - P_a} \quad (1)$$

If, on the other hand, it is assumed that the amount of the air-fuel mixture to be sucked into the engine body 1 be $G_\theta$ , then the following relationship will hold as to the amount $G_\theta$ :

$$G_\theta \ \alpha \sqrt{P_E - P_a} \quad (2)$$

From these relationships (1) and (2), it will be apparent that the amount of the exhaust gases $G_E$ to be recirculated is substantially proportional to the amount of the air-fuel mixture $G_\theta$ to be sucked into the engine body.

As has been described in the beforehand, according the present invention, the recirculation of the exhaust gases can be continued for a prolonged time period by the flow control valve assembly 7 when the engine body 1 is under as accelerating condition having a boosted exhaust gas pressure, and in this accelerating operation the amount of the exhaust gases to be recirculated can be increased when the exhaust gas pressure is at a high level. When, on the contrary, the engine body 1 is driven under a decelerating condition having a reduced exhaust gas pressure, the amount of the exhaust gases to be recirculated will be reduced accordingly.

According to the present invention thus far described, the amount of the exhaust gases to be recirculated can be proportional to the amount of the air-fuel mixture to be sucked, because the pressure in the diaphragm chamber, which is operative to actuate the flow control valve assembly, is regulated by a bleed mechanism, which is made responsive to the pressure in the constant-pressure chamber, and because the pressure in the constant-pressure chamber, through which the exhaust gases are flown for the recirculation, can be maintained substantially at the atmospheric level. It should also be appreciated as another advantage of the present invention that the diaphragm mechanism, which is operative to regulate the effective area of the flow control valve assembly, can be constructed integral with the bleed mechanism. Thus, the flow control valve assembly can be constructed so compact that it requires not only less space for its installation but also less steps for its assembly when it is installed on an automotive vehicle.

What is claimed is:

1. In an exhaust gas recirculation system for partially recirculating the exhaust gases from an exhaust system to an intake system of an internal combustion engine wherein the improvement comprises:

a flow control valve assembly comprising: an inlet port having fluid communication with the exhaust system; an outlet port having fluid communication with the intake system; first valve means interposed between said inlet port and said outlet port and including an orifice, a valve seat formed downstream of said orifice, a constant-pressure chamber defined between said orifice and said valve seat, and a first valve member movable between a seated position and an open position for regulating the effective area of a flow passage of the exhaust gases between itself and said valve seat; first diaphragm means for moving the first-named valve member, said diaphragm means including a first diaphragm connected to the first-named valve member and movable together with the same when the pressure difference thereat exceeds a predetermined level, an air source under pressure a diaphragm chamber defined by the first-named diaphragm and having fluid communication with an air source under pressure, and an air bleed hole formed in the first-named diaphragm; and second valve means including a second valve member movable between a seated position and an open position in response to the pressure in said constant-pressure chamber for regulating the effective area of said air bleed hole, so that the amount of air bleed under pressure from said diaphragm chamber may be controlled by the second-named valve member to maintain the pressure of the exhaust gases in said constant-pressure chamber substantially at the atmospheric level.

2. A flow control valve assembly according to claim 1, wherein the first-named valve means further includes a hollow valve stem carrying thereon the first-named valve member, further comprising second diaphragm means interposed between the first-named valve means and the first-named diaphragm means and including a diaphragm casing connected between said hollow valve stem and the first-named diaphragm, a second diaphragm disposed in said diaphragm casing and carrying thereon the second-named valve member, the second-named diaphragm being movable together with the second-named valve means between a seated position and an open position when the pressure difference thereat exceeds a predetermined level, a first chamber defined by the second-named diaphragm and having fluid communication with said constant-pressure chamber through said hollow valve stem, and a second chamber defined by the second-named diaphragm and formed with an air vent hole, the second-named chamber being operative to have fluid communication with the first-named diaphragm chamber when the second-named valve member is released from said open position.

3. A flow control valve assembly according to claim 2, further comprising: first biasing means for urging said diaphragm casing apart from the first-named valve means; second biasing means inserted in the second-named chamber for urging the second-named diaphragm toward the first-named valve means; and third biasing means inserted in said diaphragm chamber for urging the first-named diaphragm toward the first-named valve means.

4. A flow control valve assembly according to claim 3, further comprising adjust means for adjusting an initial position of the first-named diaphragm at a proper location which is determined by the relationship in the urging force among the first-, second- and third-named means.

5. A flow control valve assembly according to claim 1, further comprising: metering means mounted midway of the passage between said diaphragm chamber and said air source; and an air pump driven by the internal combustion engine for providing said air source.

6. A flow control valve assembly according to claim 5, wherein the effective area of said metering means is smaller than that of said air bleed hole, which in turn is smaller than that of said air vent hole.

7. A flow control valve assembly according to claim 1, wherein the face of the first-named diaphragm opposite to said diaphragm chamber is exposed to the atmospheric pressure.

* * * * *